US009466866B2

(12) United States Patent
Kroening

(10) Patent No.: US 9,466,866 B2
(45) Date of Patent: Oct. 11, 2016

(54) SYSTEMS AND METHODS FOR USING POWER DIVIDERS FOR IMPROVED FERRITE CIRCULATOR RF POWER HANDLING

(71) Applicant: Honeywell International Inc., Morristown, NJ (US)

(72) Inventor: Adam M. Kroening, Atlanta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 235 days.

(21) Appl. No.: 14/247,452

(22) Filed: Apr. 8, 2014

(65) Prior Publication Data

US 2015/0288047 A1 Oct. 8, 2015

(51) Int. Cl.

| | |
|---|---|
| ***H01P 1/38*** | (2006.01) |
| ***H01P 1/383*** | (2006.01) |
| ***H01P 1/11*** | (2006.01) |
| ***H01P 1/26*** | (2006.01) |
| ***H01P 1/39*** | (2006.01) |
| *H01P 5/20* | (2006.01) |
| *H01P 5/22* | (2006.01) |

(52) U.S. Cl.

CPC ..... *H01P 1/383* (2013.01); *H01P 1/11* (2013.01); *H01P 1/262* (2013.01); *H01P 1/38* (2013.01); *H01P 1/39* (2013.01); *H01P 5/20* (2013.01); *H01P 5/22* (2013.01)

(58) Field of Classification Search

CPC ..... H01P 1/32; H01P 1/36; H01P 1/38
USPC ..... 333/1.1, 24.2; 455/78
See application file for complete search history.

(56) References Cited

U.S. PATENT DOCUMENTS

| | | | | |
|---|---|---|---|---|
| 2,702,371 A | | 2/1955 | Sunstein | |
| 3,624,566 A | | 11/1971 | Perreault | |
| 4,039,947 A | | 8/1977 | Miedema | |
| 4,837,580 A | | 6/1989 | Frazita | |
| 5,097,233 A | | 3/1992 | Pekarek | |
| 5,815,803 A | * | 9/1998 | Ho | H04B 1/525 333/1.1 |
| 6,108,313 A | * | 8/2000 | Lee | H04B 1/005 333/1.1 |

(Continued)

FOREIGN PATENT DOCUMENTS

JP 6083402 5/1985

OTHER PUBLICATIONS

U.S. Patent and Trademark Office, "Restriction Requirement", "from U.S. Appl. No. 14/247,454", Jan. 22, 2016, pp. 1-5, Published in: US.

(Continued)

*Primary Examiner* — Stephen E Jones
(74) *Attorney, Agent, or Firm* — Fogg & Powers LLC

(57) ABSTRACT

Systems and methods for using power dividers for improved ferrite circulator RF power handling are provided. In one embodiment, a method for switching RF power using a high power circulator switch comprises: operating a ferrite circulator switch to direct RF power to either a first output port or a second output port, the ferrite circulator switch comprising at least three ferrite circulators arranged as a triad switch, wherein a first circulator is coupled to the first output port, a second circulator is coupled to the second output port; and using a waveguide power divider coupled between the first circulator and the second circulator, distributing reflected RF power received at the first output port or the second output port between a plurality of waveguide loads.

10 Claims, 5 Drawing Sheets

(56) References Cited

U.S. PATENT DOCUMENTS

| | | | |
|---|---|---|---|
| 6,335,665 | B1 | 1/2002 | Mendelsohn |
| 6,885,257 | B2 | 4/2005 | Kroening |
| 7,561,003 | B2 | 7/2009 | Kroening |
| 7,683,731 | B2 | 3/2010 | Kroening |
| 7,816,995 | B1 | 10/2010 | Allen et al. |
| 2003/0107447 | A1 | 6/2003 | Kroening |
| 2005/0030117 | A1 | 2/2005 | Kroening |
| 2013/0271232 | A1 | 10/2013 | Rose et al. |
| 2014/0049335 | A1 | 2/2014 | Kroening |
| 2015/0180109 | A1 | 6/2015 | Kroening |
| 2015/0288046 | A1 | 10/2015 | Kroening |

OTHER PUBLICATIONS

Alcivar, "Seminar Subjects: An Elementary Introduction to Ferrite Isolators, Circulators and RF Loads", 1992, pp. 1-14, Publisher: TX RX Systems Inc.

"Magic tees", "retrieved Apr. 7, 2014 from Internet http://www.microwaves101.com/encyclopedia/magictee.cfm", Mar. 17, 2008, pp. 1-5.

"Branchline couplers", "retrieved Apr. 7, 2014 from Internet http://www.microwaves101.com/encyclopedia/Branchline_couplers.cfm", May 11, 2011.

"Radar Basics", "Retrieved Mar. 14, 2014 from http://www.radartutorial.eu/17.bauteile/bt33.en.html", , p. 1.

Kroening, "Circulator With Ferrite Element Attached to Waveguide Sidewalls", "U.S. Appl. No. 13/949,668, filed Jul. 24, 2013", Jul. 24, 2013, pp. 1-31.

Wang et al., "Design and Construction of a 7MW High Power Circulator", "Proceedings of the Second Asian Particle Accelerator Conference", 2001, pp. 763-765, Published in: CN.

Williams et al., "Communications Satellite Antennas With On-Orbit Pattern Flexibility", "Microwave Journal", Aug. 2004, pp. 1-8, Publisher: Horizon House Publications, Inc.

European Patent Office, "Extended European Search Report from EP Application No. 15160667.0 mailed Aug. 3, 2015", "from Foreign Counterpart of U.S. Appl. No. 14/247,452", Aug. 3, 2015, pp. 1-10, Published in: EP.

European Patent Office, "Extended European Search Report from EP Application No. 15160673.8 mailed Aug. 3, 2015", "from Foreign Counterpart of U.S. Appl. No. 14/247,454", Aug. 3, 2015, pp. 1-9, Published in: EP.

Kroening, "Systems and Methods for Improved Ferrite Circulator RF Power Handling", "U.S. Appl. No. 14/247,454, filed Apr. 8, 2014", pp. 1-22, Published in: US.

European Patent Office, Communication Under Rule 71(3) from EP Application No. 15160673.8 mailed Apr. 29, 2016, From Foreign Counterpart of U.S Appl. No. 14/247,454, Apr. 29, 2016, pp. 1-26, Published in: EP.

U.S. Patent and Trademark Office, Notice of Allowance, from U.S. Appl. No. 14/247,454, May 6, 2016, pp. 1-30, Published in: US.

* cited by examiner

SYSTEMS AND METHODS FOR USING POWER DIVIDERS FOR IMPROVED FERRITE CIRCULATOR RF POWER HANDLING

CROSS-REFERENCE TO RELATED APPLICATIONS

This application is related to U.S. patent application Ser. No. 14/247,454 entitled, "SYSTEMS AND METHODS FOR IMPROVED FERRITE CIRCULATOR RF POWER HANDLING", filed on even date herewith, which is incorporated herein by reference in its entirety.

BACKGROUND

Ferrite switching circulators can be used to implement downlink beam hopping techniques in multibeam broadband satellite systems, where a single high power RF input can be quickly switched to multiple output antennas. A single 3-port ferrite circulator switch, although simple to implement, compact and relatively inexpensive, has a downside in that if a short or open circuit occurs within a connected output port, or if an output port is not properly connected, then radio frequency (RF) power can be reflected back into the switch. This reflected power can travel back through the circulator, exit another port of the circulator, and energize equipment that should have remained de-energized. To provide isolation between switched output ports, designs have been introduced comprising a configuration of three multifunction waveguide ferrite circulators (sometimes referred to as a ferrite circulator "triad") which include three ferrite junction switches and two high power loads. In a triad design, one of two high power loads is coupled to a first circulator while the other high power load is coupled to a second circulator. The input to a third ferrite circulator is switched between two outputs, where the first output is coupled to the input of the first ferrite circulator, and the third circulator's second output is coupled to the input of the second circulator. In such a triad design, if a short circuit occurs on a connection to the output port of the first ferrite circulator, then the reflected RF power is reflected back into the circulator and directed to its high power load which serves to absorb the reflected RF power. Similarly, the high power load coupled to the second circulator will receive and absorb reflected RF power received back in from the output port of the second circulator. Since minimal reflected RF power is transmitted back to the third circulator, isolation between the two output ports of the triad is achieved.

In order to improve satellite throughput in satellite communications, specified RF power levels used by satellites have been on the rise. The increases in RF power level may come either through improvements in output power of the on-board high power transmitters or through the combining of several high power transmitters. For this increase in RF power level, the limitation in the triad switches is the power handling of the ferrite switches and high power loads. That is, the high power loads used by the triad switches need to be able to handle the full transmit power levels (which can be on the order of 50 to 500 watts, for example) in case of a short circuit at an output to the switch. The high power loads need to be capable of absorbing the full reflected input power, which typically translates into the need for the high power loads to be larger and heavier. In the design of satellite systems, however, the space available within the satellite is typically a premium resource, and any extra weight has a direct detrimental effect in the cost associated with launching the satellite into orbit.

For the reasons stated above and for other reasons stated below which will become apparent to those skilled in the art upon reading and understanding the specification, there is a need in the art for improved systems and methods for improved ferrite circulator RF power handling.

SUMMARY

The Embodiments of the present disclosure provide methods and systems for improved ferrite circulator RF power handling and will be understood by reading and studying the following specification.

Systems and methods for using power dividers for improved ferrite circulator RF power handling are provided. In one embodiment, a method for switching RF power using a high power circulator switch comprises: operating a ferrite circulator switch to direct RF power to either a first output port or a second output port, the ferrite circulator switch comprising at least three ferrite circulators arranged as a triad switch, wherein a first circulator is coupled to the first output port, a second circulator is coupled to the second output port; and using a waveguide power divider coupled between the first circulator and the second circulator, distributing reflected RF power received at the first output port or the second output port between a plurality of waveguide loads.

DRAWINGS

Embodiments of the present disclosure can be more easily understood and further advantages and uses thereof more readily apparent, when considered in view of the description of the preferred embodiments and the following figures in which.

In accordance with common practice, the various described features are not drawn to scale but are drawn to emphasize features relevant to the present disclosure. Reference characters denote like elements throughout figures and text.

DETAILED DESCRIPTION

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present disclosure. The following detailed description is, therefore, not to be taken in a limiting sense.

Embodiments of the present disclosure address the needs of triad circulator junction switches to be able to absorb the full reflected input power through new switch designs which incorporate a waveguide power divider to distribute reflected RF energy among multiple waveguide loads. By distributing reflected RF energy to multiple waveguide loads, it is possible to utilize loads having lower power ratings, which are relatively lighter, smaller and less expensive. Further, as explained below, the waveguide power divider is positioned between the output circulators of the triad circulator junction switch so that reflected RF power from both outputs can be applied to the same waveguide power divider, further reducing the total number of waveguide loads necessary to mitigate reflected RF energy.

Figure 1:
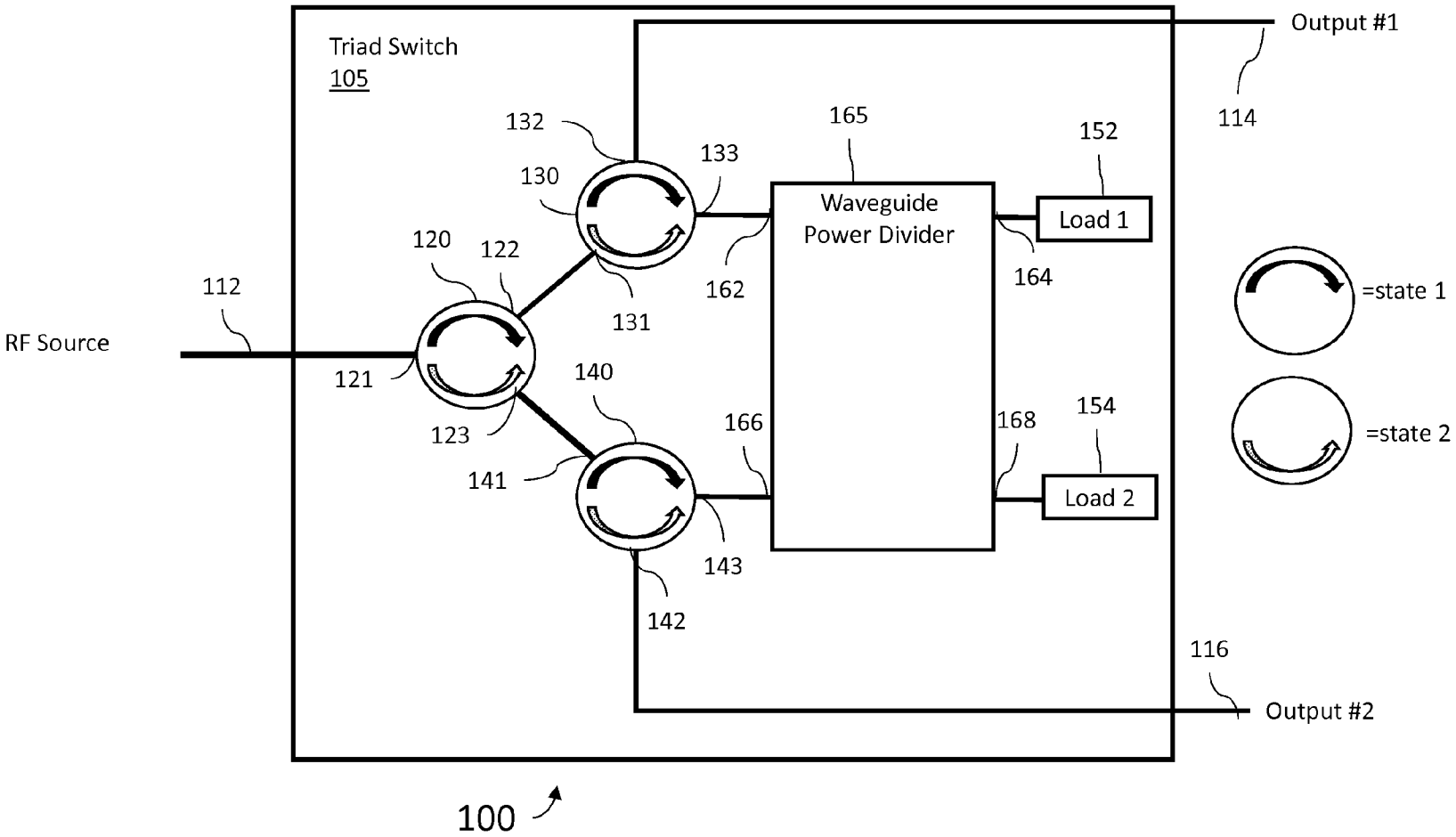
FIG. 1 is a block diagram illustrating a triad ferrite circulator switch of one embodiment of the present disclosure.

FIG. 1 is a diagram generally at 100 illustrating a triad ferrite circulator switch 105 (also referred to herein simply as "triad switch" 105) of one embodiment of the present disclosure. Triad switch 105 includes an input port 112 and two output ports 114 and 116. Triad switch 105 functions as a switchable waveguide, receiving an RF energy wave at point 112 and switching the wave to either ports 114 or 116. This switching is achieved while maintaining a high degree of isolation (e.g. >30 dB) between ports 114 and 116. In the embodiment shown in FIG. 1, triad switch 105 comprises a triad of ferrite circulators 120, 130 and 140. Input port 112 is coupled to an input 121 of a ferrite circulator 120 which is switched between two outputs 122 and 123. The circulator 120 output 122 is coupled to the input 131 of ferrite circulator 130, while the circulator 120 output 123 is coupled to the input 141 of ferrite circulator 140. Port 132 of ferrite circulator 130 serves as the first output port 114 of triad switch 105 while port 142 of ferrite circulator 140 serves as the second output port 116 of triad switch 105. In this disclosure, the ferrite circulator 130 coupled to first output port 114 may be referred to as the "first circulator 130", the ferrite circulator 140 coupled to second output port 116 may be referred to as the "second circulator 140", and the ferrite circulator 120 coupled to the input port 112 may be referred to as the "third circulator 120."

For the embodiment shown in FIG. 1, a four port waveguide power divider 165 comprises a first port 162 coupled to port 133 of the first circulator 130 and a second port 166 coupled to port 143 of the second circulator 140. Port 164 of waveguide power divider 165 is coupled to a first waveguide load 152 while port 168 of waveguide power divider 165 is coupled to a second waveguide load 154. In operation, in order to dissipate any reflected RF power received back into output ports 114 and 116, that power is directed to waveguide power divider 165.

Triad switch 105 has two operating states. In state 1, port 114 is "on" (i.e. port 114 is coupled to, and receives RF energy from, input port 112) while port 116 is "off" (i.e., isolated from both the input port 112 and port 114). In state 2, port 116 is "on" (i.e. port 116 is coupled to, and receives RF energy from, input port 112) while port 114 is "off" (i.e., isolated from both the input port 112 and port 116).

Circulator 120 comprises a ferrite circulator waveguide that includes input port 121, and first and second output ports 122, 123. Depending on the selected state of triad switch 105, the direction of circulation within circulator 120 is either clockwise (CW) or counter-clockwise (CCW), and an RF energy wave entering input port 121 flows either to port 122 or port 123. For example, in the embodiment shown in FIG. 1, when triad switch 105 is in the first state, circulator 120 directs energy through the circulator in a first direction to its first output port 122 and out to the first circulator 130. When triad switch 105 is in the second state, circulator 120 directs energy through the circulator in a second direction to its second output port 123 and out to the second circulator 140. Circulators 130 and 140 also each comprises ferrite circulator waveguides, each having input ports 131 and 141, respectively. Circulator 130 includes an output port 132 that serves as the first output port 114 of triad switch 105. Circulator 140 includes an output port 142 that serves as the second output port 116 of triad switch 105.

In one embodiment, this two-state operation is achieved by switching circulator 120 while circulators 130 and 140 are maintained in a fixed state. That is, when circulator 120 is switched to provide an output to circulator 130, the RF energy is sent to output port 132 and first output port 114 of triad switch 105. Any reflected RF power received back into port 114 will enter into circulator 130 and travel around the circulator in the first direction to port 162 of waveguide power divider 165. When circulator 120 is switched to provide an output to circulator 140, the RF energy is sent to output port 142 and second output port 116 of triad switch 105. Any reflected RF power received back into port 116 will enter into circulator 140 and travel around the circulator in the second direction to port 166 of waveguide power divider 165.

In other embodiments, this two-state operation is achieved by the coordinated switching of the three circulators 120, 130 and 140. In that case, when triad switch 105 is in the first state, circulator 130 is switched "on" so that RF energy entering input port 131 flows through the circulator in the first direction and then out through port 114. While triad switch 105 is in this first state, any reflected RF power received back into port 114 will enter into circulator 130 and travel around the circulator in the first direction to port 162 of waveguide power divider 165. When triad switch 105 is in the second state, circulator 130 is switched "off." Any energy entering input port 131 (which should be negligible since circulator 120 is switched to circulator 140 in this first state) flows around the circulator in a second direction (opposite direction to the first direction) to port 133 and is directed to port 162 of waveguide power divider 165.

Similarly, when triad switch 105 is in the second state, circulator 140 is switched "on", so that RF energy entering its input port 141 flows through the circulator in the second direction and then out through port 116. While triad switch 105 is in this second state, any reflected RF power received back into port 116 will enter into circulator 140 and travel around the circulator in the second direction to port 166 of waveguide power divider 165. When triad switch 105 is in the first state, circulator 140 is switched "off." Any energy entering input port 141 (which should be negligible since circulator 120 is switched to circulator 130 in this second state) flows around the circulator in the first direction (opposite direction to the second direction) to port 143 and is directed to port 166 of waveguide power divider 165. The triad of switching circulators 120, 130 and 140 are always switched in lock-step as a group. At any one instance in time, one, and only one, of the circulators 130, 140 is switched to the "on" state. Similarly, at any one instance in time, circulator 120 is switched to only one of the circulators 130, 140, whichever is currently in the "on" state. In this way, reflected RF power back into the output ports 114 or 116 is always directed to either port 162 or port 166 of waveguide power divider 165, and in turn distributed between waveguide load 152 and 154.

With the embodiments provided by this disclosure, no one load element needs to be rated to handle the full power of a reflected wave. For example, in one implementation where reflected RF power is split evenly by waveguide power divider 165 between loads 152 and 154 (i.e. a 3 dB power divider), then each of the loads need only be rated for absorbing ½ of the maximum potential reflected RF power. In some embodiments, waveguide loads 152 and 154 are implemented, for example, using attenuating wave guides that comprises a tapered wedge design and/or absorbent material that substantially absorbs and spreads out the energy from reflected RF power along the length of the waveguide. It should also be appreciated that in other embodiment, waveguide power divider 165 may divide power between more than just two waveguide loads.

Figure 2:
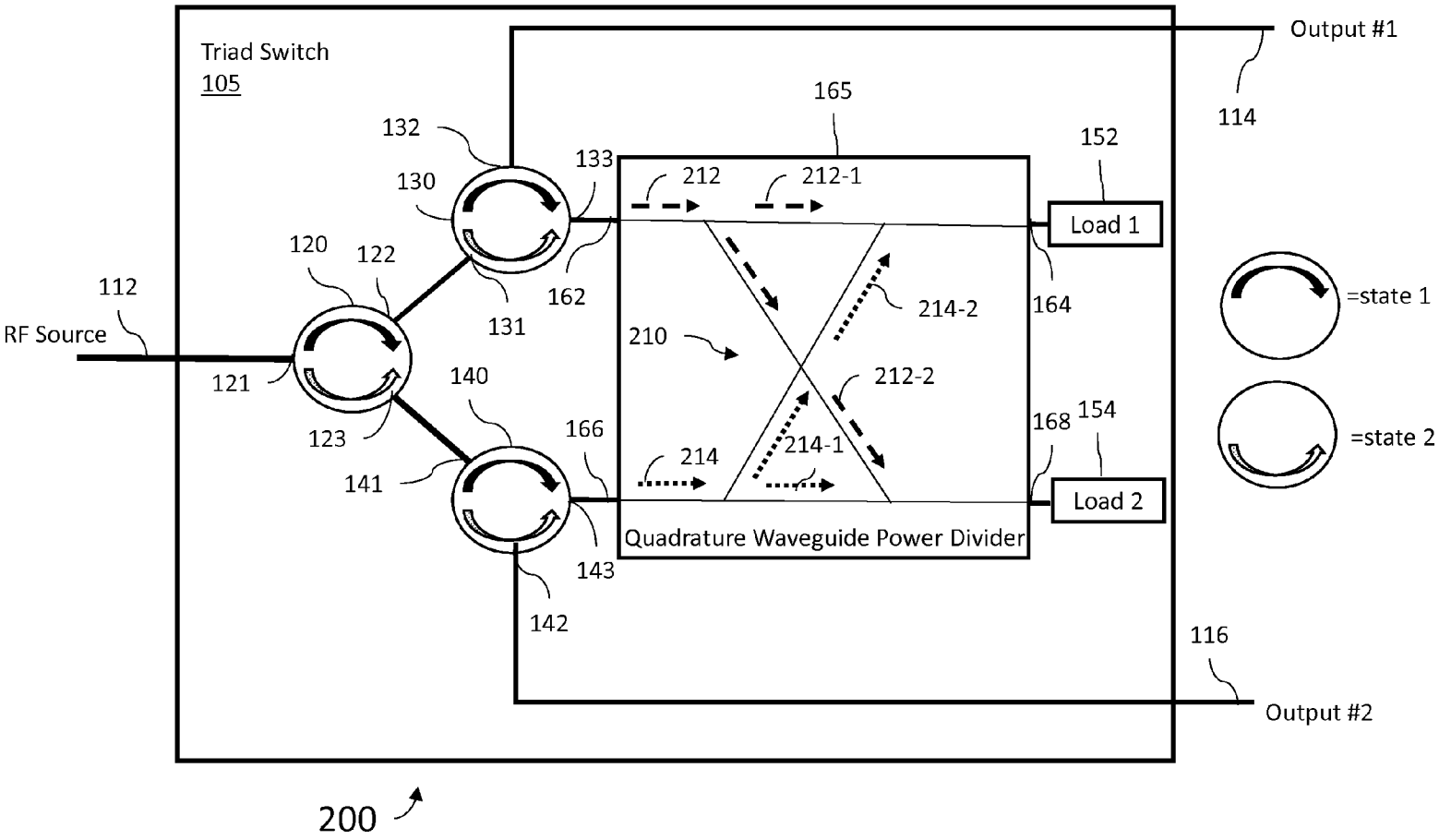
FIG. 2 is a block diagram illustrating a triad ferrite circulator switch of one embodiment of the present disclosure.

FIG. 2 is a block diagram shown generally at 200 where the waveguide power divider 165 for triad switch 105 is implemented using a quadrature coupler 210. In this embodiment, with triad switch 105 in the first state, reflected RF power received back into output 114 will travel CW around circulator 130 from port 132 to 133 and enter waveguide power divider 165 at port 162 (indicated at 212) and is split into two different waveguide paths (shown at 212-1 and 212-2). The portion split to path 212-1 is delivered to and absorbed by waveguide load 152. The portion split to path 212-2 is delivered to and absorbed by waveguide load 154. When triad switch 105 is switched to the second state, reflected RF power received back into output 116 will travel CCW around circulator 140 from port 142 to 143 and enter waveguide power divider 165 at port 166 (indicated at 214) and is split into different waveguide paths (shown at 214-1 and 214-2). The portion split to path 214-1 is delivered to and absorbed by waveguide load 154. The portion split to path 214-2 is delivered to and absorbed by waveguide load 152. In the embodiment shown in FIG. 2, quadrature coupler 210 is a 3 dB coupler, meaning that the power of an RF wave entering into either port 162 or 166 is evenly split between loads 152 and 154. In other embodiments, quadrature coupler 210 may be alternately configured to unevenly split the power between the loads 152 and 154. For example, in an implementation where load 152 is rated higher than load 154, quadrature coupler 210 may be configured to distribute a larger portion of reflected RF power to load 152. An uneven split such as described here may be applicable in cases where the reflected power received at one output may be greater than the reflected power received at the other output.

Figure 3:
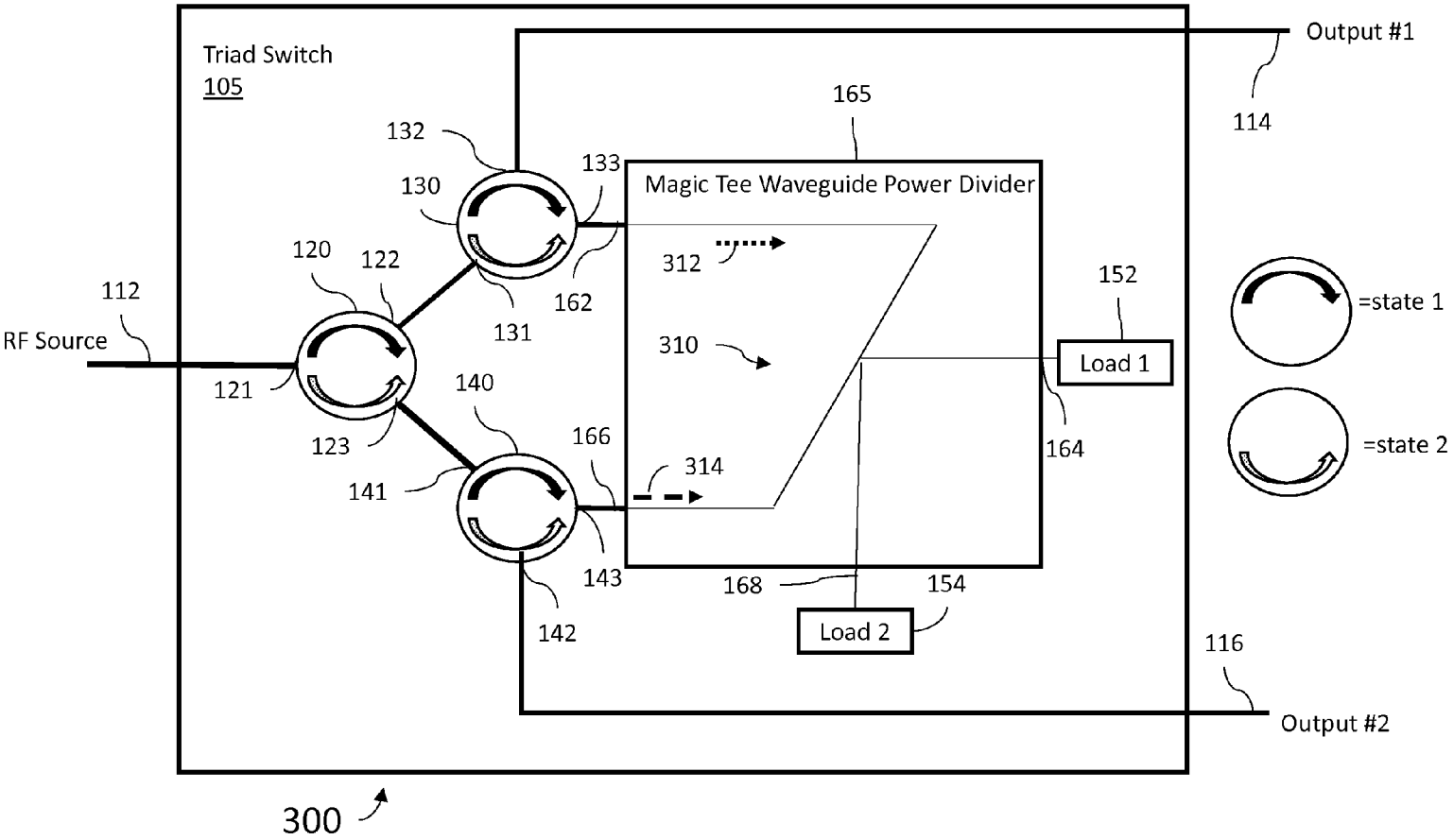
FIG. 3 is a block diagram illustrating a triad ferrite circulator switch of one embodiment of the present disclosure.

FIG. 3 is a block diagram shown generally at 300 where the waveguide power divider 165 for triad switch 105 is implemented using a Magic Tee waveguide power divider 310. In this embodiment, with triad switch 105 in the first state, reflected RF power received back into output 114 will travel CW around circulator 130 from port 132 to 133 and enters waveguide power divider 165 at port 162 (indicated at 312). When triad switch 105 is switched to the second state, reflected RF power received back into output 116 will travel CCW around circulator 140 from port 142 to 143 and enters waveguide power divider 165 at port 166 (indicated at 314). A magic tee is a four-port hybrid splitter, realized in waveguide. In the embodiment shown in FIG. 3, port 162 leads to a co-linear port and port 166 leads to a second co-linear port (though in other embodiments, these may be reversed). Ports 164 and 168 comprise, respectively an H-plane port and an E-plane port of the magic tee 310. A reflected RF power signal (shown at 312) incident on port 162 is equally split between ports 164 and 168 (which are coupled, respectively, to waveguide loads 152 and 154), and isolated from port 166. A reflected RF power signal (shown at 314) incident on port 166 will also be equally split between ports 164 and 168, and will be isolated from port 162.

It should be appreciated that additional embodiments include multiple instances of triad switches such as switch 105 coupled together in various combinations to achieve different switching configurations. That is, the input port 112 of a triad switch may itself be coupled to a switched source of RF power. For example, input port 112 may be connected to the output port of an upstream circulator, or even to the output port of a prior upstream triad switch (which may, or may not, be a triad switch having a configuration such as shown with respect to triad switch 105). In this way, a 1×4 switch configuration may be obtained, as an example, by coupling the respective input ports 112 of two instances of triad switch 105 to respective outputs of an upstream switching device which is coupled to the RF source.

Figure 4:
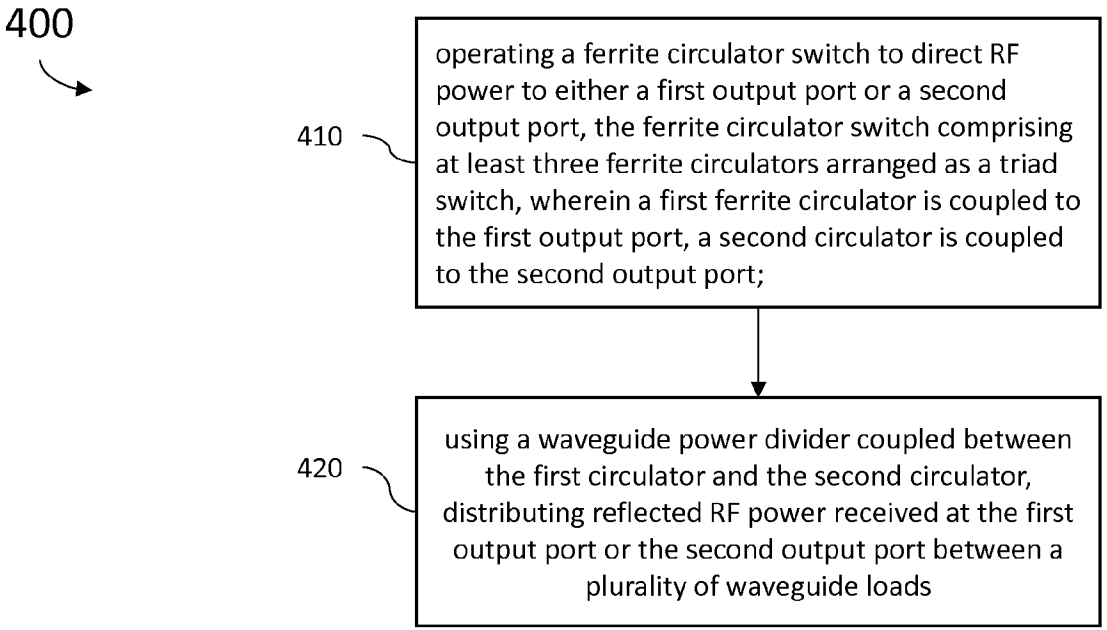
FIG. 4 is a flow chart illustrating a method of one embodiment of the present disclosure.

FIG. 4 is a flow chart illustrating a method 400 of one embodiment of the present disclosure. In some embodiments, the method 400 may be implemented using any of the various embodiments and implementations discussed above with respect to triad switch 150. In other embodiments, other variations on triad switch 150 may be utilized.

Method 400 begins at 410 with operating a ferrite circulator switch to direct RF power to either a first output port or a second output port, the ferrite circulator switch comprising at least three ferrite circulators arranged as a triad switch, wherein a first ferrite circulator is coupled to the first output port, a second circulator is coupled to the second output port. As mentioned above, a triad ferrite circulator switch comprises a triad of ferrite circulators, such as discussed above.

In one embodiment, the ferrite circulator switch further comprises a third circulator coupled to an input of the ferrite circulator switch. The third circulator directs RF power received at the input of the ferrite circulator switch to the first ferrite circulator when the switch is operating in the first state and directs RF power received at the input of the ferrite circulator switch to the second ferrite circulator when the switch is operating in the second state. In some embodiments, the first and second circulators (i.e., those connected to the first and second output of the triad ferrite circulator switch, are fixed to always direct RF power received from the third circulator to the outputs of the triad ferrite circulator switch. In other embodiments, the first, second and third circulators are each controlled in a lock-step manner such that the triad ferrite circulator switch is operated in either a first state or a second state as described above.

The method proceeds to 420 with using a waveguide power divider coupled between the first circulator and the second circulator, distributing reflected RF power received at the first output port or the second output port between a plurality of waveguide loads. When the ferrite circulator switch is switched to the first state and directs RF power to the first output, any reflected RF power received at the first output through the first circulator is directed to a first input port of the waveguide power divider. When the ferrite circulator switch is switched to the second state to direct RF power to the second output, any reflected RF power received at the second output through the second circulator of the triad switch is directed to the second input port of the waveguide power divider. In alternate embodiments, such as previously described above, the waveguide power divider can either evenly, or unevenly, distribute any reflected RF power received at the first or second ports of the waveguide power divider between the plurality of waveguide loads.

In some embodiments, the waveguide power divider in method 400 comprises a four port quadrature coupler having a first input port coupled to the first ferrite circulator and a second input port coupled to the second ferrite circulator, which may be a 3 dB coupler that evenly splits reflected power between the two waveguide loads. In other embodiments, the waveguide power divider comprises a magic tee waveguide power divider. In one such embodiment the magic tee waveguide power divider's H-plane port is coupled to the first waveguide load while the E-plane port is coupled to the second waveguide load.

Figure 5:
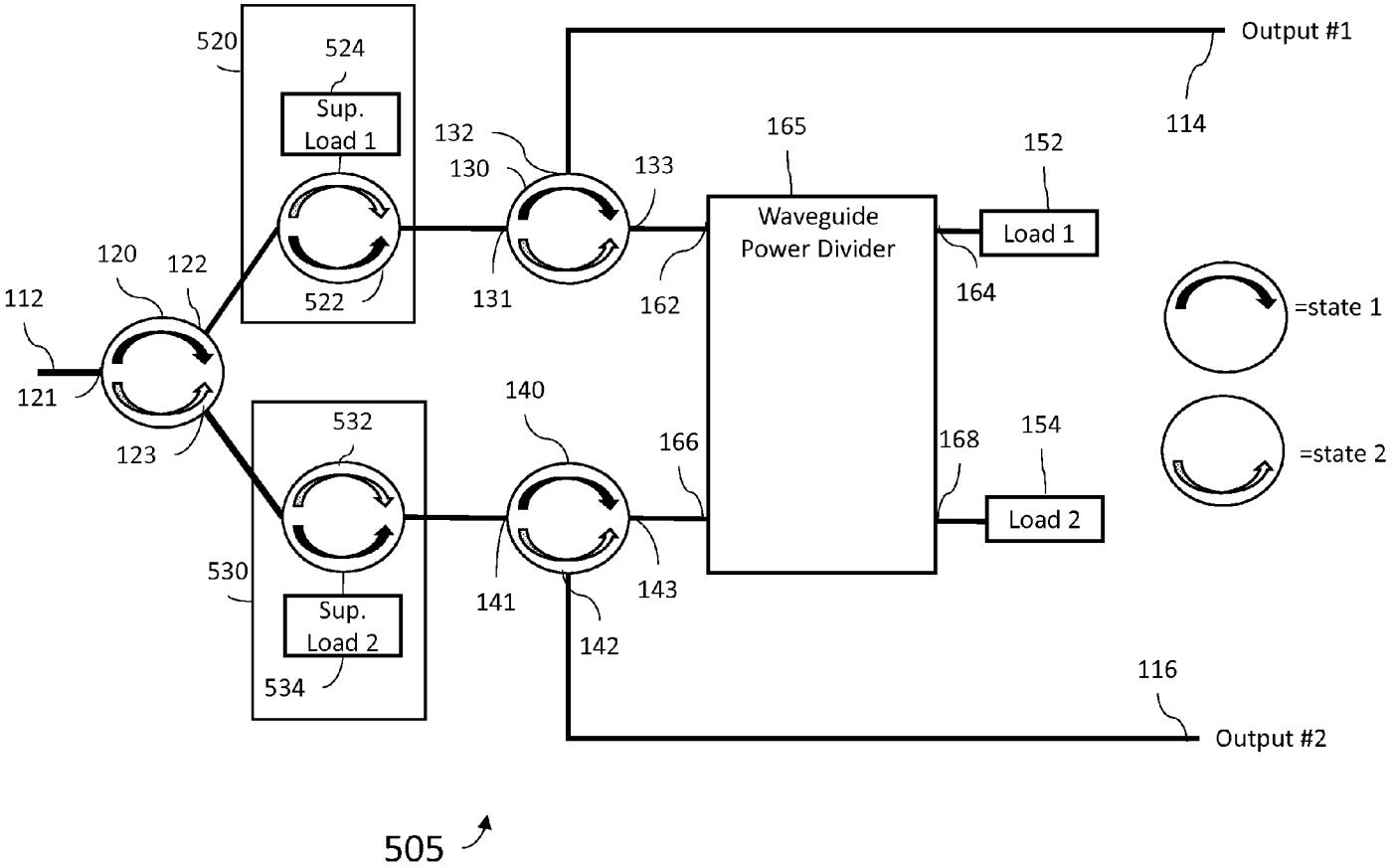
FIG. 5 is a block diagram illustrating a triad ferrite circulator switch of one embodiment of the present disclosure.

For any of the embodiments described herein, additional embodiments may include more triad switches that further comprise supplemental isolators intervening between the input coupled circulator (such as circulator 120) and the two output coupled circulators (such as circulators 130 and 140). FIG. 5 illustrates one such embodiment where a triad switch 505 comprises the same elements as triad switch 105, but further includes supplemental isolators 520 and 530. In the embodiment shown in FIG. 5, supplemental isolator 520 comprises a circulator 522 coupled to a first supplemental load 524 and is positioned between circulator 120 and circulator 130. Supplemental isolator 530 comprises a circulator 532 coupled to a second supplemental load 534 and is positioned between circulator 120 and circulator 140. With respect to supplemental isolator 520, in operation, RF power received from circulator 120 is directed through circulator 522 to circulator 130 and then to output 114. With respect to supplemental isolator 530, in operation, RF power received from circulator 120 is directed through circulator 532 to circulator 140 and then to output 116. As before, any reflected RF power received at either output 114 or 116 is directed to waveguide power divider 165 and waveguide loads 152 and 154. In the case where the primary loads 152 and 154 are unable to completely absorb the reflected RF power, the balance of that reflected RF power exits waveguide power divider 165 and is directed through circulators 130 and 140 to one or both of supplemental isolators 520 and 530. Reflected power received at supplemental isolators 520 and 530 is then directed (by circulators 522 and 532) to the supplemental waveguide loads 524 and 534 which will further attenuate the reflected RF power, thus providing additional isolation between output ports 114 and 116. In still other embodiments, additional supplemental isolators, such as 520 and 530, may similarly be coupled between the input coupled circulator 120 and the two output coupled circulators 130 and 140 to provide still further isolation.

Example Embodiments

Example 1 includes a high power circulator switch, the switch comprising: at least three ferrite circulators, the at least three ferrite circulators arranged as a triad switch, wherein a first circulator is coupled to a first output of the triad switch, a second circulator is coupled to a second output of the triad switch, and a third circulator coupled to an input of the triad switch; a waveguide power divider comprising a first port coupled to the first circulator and a second port coupled to the second circulator; at least two waveguide loads including a first waveguide load and a second waveguide load, wherein the first waveguide load is coupled to a third port of the waveguide power divider and the second waveguide load is coupled to a fourth port of the waveguide power divider; wherein the waveguide power divider distributes any RF power received at the first port of the waveguide power divider between the at least two waveguide loads; and wherein the waveguide power divider distributes any RF power received at the second port of the waveguide power divider between the at least two waveguide loads.

Example 2 includes the switch of example 1, wherein when the triad switch is switched to a first state, RF power received at the input is directed through the third circulator and the first circulator to the first output, and any reflected RF power received at the first output is directed by the first circulator to the first port of the waveguide power divider; and wherein when the triad switch is switched to a second state, RF power received at the input is directed through the third circulator and the second circulator to the second output, and any reflected RF power received at the second output is directed by the second circulator to the second port of the waveguide power divider.

Example 3 includes the switch of any of examples 1-2, wherein the first circulator and the second circulator remain in a fixed switching state when a switching state of the third circulator is switched.

Example 4 includes the switch of any of examples 1-3, wherein the first circulator and the second circulator are switched between states in lock-step with switching of the third circulator.

Example 5 includes the switch of any of examples 1-4, wherein the waveguide power divider evenly distributes any reflected RF power received at the first or second ports of the waveguide power divider between the at least two waveguide loads.

Example 6 includes the switch of any of examples 1-5, wherein the waveguide power divider unevenly distributes any reflected RF power received at the first or second ports of the waveguide power divider between the at least two waveguide loads.

Example 7 includes the switch of any of examples 1-6, wherein the waveguide power divider comprises a four port quadrature coupler having a first input port coupled to the first circulator and a second input port coupled to the second circulator.

Example 8 includes the switch of any of examples 1-7, wherein the waveguide power divider comprises a magic tee waveguide power divider.

Example 9 includes the switch of example 8, wherein the magic tee waveguide power divider comprises an H-plane port coupled to the first waveguide load and an E-plane port coupled to the second waveguide load.

Example 10 includes a method for switching RF power using a high power circulator switch, the method comprising: operating a ferrite circulator switch to direct RF power to either a first output port or a second output port, the ferrite circulator switch comprising at least three ferrite circulators arranged as a triad switch, wherein a first circulator is coupled to the first output port, a second circulator is coupled to the second output port; using a waveguide power divider coupled between the first circulator and the second circulator, distributing reflected RF power received at the first output port or the second output port between a plurality of waveguide loads.

Example 11 includes the method of examples 10, further comprising: when the ferrite circulator switch is switched to a first state to direct RF power to the first output, directing any reflected RF power received at the first output through the first circulator to a first input port of the waveguide power divider; when the ferrite circulator switch is switched to a second state to direct RF power to the second output, directing any reflected RF power received at the second output through the second circulator of the triad switch to the second input port of the waveguide power divider.

Example 12 includes the method of any of examples 10-11, wherein the waveguide power divider evenly distributes any reflected RF power received at the first or second ports of the waveguide power divider between the plurality of waveguide loads.

Example 13 includes the method of any of examples 10-12, wherein the waveguide power divider unevenly distributes any reflected RF power received at the first or second ports of the waveguide power divider between the plurality of waveguide loads.

Example 14 includes the method of any of examples 10-13, wherein the ferrite circulator switch further comprises a third circulator coupled to an input of the ferrite circulator switch, wherein the method further comprises: the third circulator directing RF power received at the input of the ferrite circulator switch to the first circulator when the switch is operating in the first state; and the third circulator directing RF power received at the input of the ferrite circulator switch to the second circulator when the switch is operating in the second state.

Example 15 includes the method of any of example 10-14, wherein the first circulator and the second circulator remain in a fixed switching state when a switching state of the third circulator is switched.

Example 16 includes the method of any of examples 10-14, wherein the first circulator and the second circulator are switched between states in lock-step with switching of the third circulator.

Example 17 includes the method of any of examples 10-16, wherein the waveguide power divider comprises a four port quadrature coupler having a first input port coupled to the first circulator and a second input port coupled to the second circulator.

Example 18 includes the method of any of examples 10-17, wherein the waveguide power divider comprises a magic tee waveguide power divider.

Example 19 includes the method of any example 18, wherein the magic tee waveguide power divider comprises an H-plane port coupled to a first waveguide load and an E-plane port coupled to a second waveguide load.

Example 20 includes the switch of any of examples 1-9 or method of any of examples 10-19, further comprising at least a first supplemental isolator intervening between the first circulator and the third circulator, and at least a second supplemental isolator intervening between the second circulator and the third circulator.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present disclosure. Therefore, it is manifestly intended that this invention be limited only by the claims and the equivalents thereof.

What is claimed is:

1. A high power circulator switch, the switch comprising:

at least three ferrite circulators, the at least three ferrite circulators arranged as a triad switch, wherein a first circulator is coupled to a first output of the triad switch, a second circulator is coupled to a second output of the triad switch, and a third circulator coupled to an input of the triad switch;

a waveguide power divider comprising a first port coupled to the first circulator and a second port coupled to the second circulator;

at least two waveguide loads including a first waveguide load and a second waveguide load, wherein the first waveguide load is coupled to a third port of the waveguide power divider and the second waveguide load is coupled to a fourth port of the waveguide power divider;

wherein the waveguide power divider distributes any RF power received at the first port of the waveguide power divider between the at least two waveguide loads; and wherein the waveguide power divider distributes any RF power received at the second port of the waveguide power divider between the at least two waveguide loads.

2. The switch of claim 1, wherein the waveguide power divider comprises a four port quadrature coupler having a first input port coupled to the first circulator and a second input port coupled to the second circulator.

3. The switch of claim 1, further comprising at least a first supplemental isolator intervening between the first circulator and the third circulator, and at least a second supplemental isolator intervening between the second circulator and the third circulator.

4. The switch of claim 1, wherein the waveguide power divider comprises a magic tee waveguide power divider.

5. The switch of claim 4, wherein the magic tee waveguide power divider comprises an H-plane port coupled to the first waveguide load and an E-plane port coupled to the second waveguide load.

6. The switch of claim 1, wherein when the triad switch is switched to a first state, RF power received at the input is directed through the third circulator and the first circulator to the first output, and any reflected RF power received at the first output is directed by the first circulator to the first port of the waveguide power divider; and wherein when the triad switch is switched to a second state, RF power received at the input is directed through the third circulator and the second circulator to the second output, and any reflected RF power received at the second output is directed by the second circulator to the second port of the waveguide power divider.

7. The switch of claim 6, wherein the first circulator and the second circulator remain in a fixed switching state when a switching state of the third circulator is switched.

8. The switch of claim 6, wherein the first circulator and the second circulator are switched between states in lock-step with switching of the third circulator.

9. The switch of claim 6, wherein the waveguide power divider evenly distributes any reflected RF power received at the first or second ports of the waveguide power divider between the at least two waveguide loads.

10. The switch of claim 6, wherein the waveguide power divider unevenly distributes any reflected RF power received at the first or second ports of the waveguide power divider between the at least two waveguide loads.

* * * * *